US011377599B1

(12) United States Patent
Ganji

(10) Patent No.: US 11,377,599 B1
(45) Date of Patent: Jul. 5, 2022

(54) DELAYED THERMAL CRACKING SYSTEM, APPARATUS, AND METHOD

(71) Applicant: Kazem Ganji, Norman, OK (US)

(72) Inventor: Kazem Ganji, Norman, OK (US)

( * ) Notice: Subject to any disclaimer, the term of this patent is extended or adjusted under 35 U.S.C. 154(b) by 0 days.

(21) Appl. No.: 17/460,728

(22) Filed: Aug. 30, 2021

(51) Int. Cl.

| | |
|---|---|
| ***C10G 9/00*** | (2006.01) |
| ***C10B 55/00*** | (2006.01) |
| ***C10B 3/00*** | (2006.01) |
| ***C10B 7/00*** | (2006.01) |

(52) U.S. Cl.
CPC ..... *C10G 9/005* (2013.01); *C10B 3/00* (2013.01); *C10B 7/00* (2013.01); *C10B 55/00* (2013.01); *C10G 2300/301* (2013.01); *C10G 2300/302* (2013.01); *C10G 2300/308* (2013.01); *C10G 2300/4006* (2013.01)

(58) Field of Classification Search
CPC ..... C10G 9/005; C10G 2300/301; C10G 2300/302; C10G 2300/308; C10G 2300/4006; C10B 3/00; C10B 7/00; C10B 55/00
See application file for complete search history.

(56) References Cited

U.S. PATENT DOCUMENTS

2009/0127090 A1* 5/2009 Ganji ..... C10B 55/00 201/31

* cited by examiner

*Primary Examiner* — Randy Boyer
*Assistant Examiner* — Juan C Valencia
(74) *Attorney, Agent, or Firm* — Dennis D. Brown; Brown Patent Law, P.L.L.C.

(57) ABSTRACT

A delayed thermal cracking process, system, and apparatus for heavy (i.e., high boiling point) coker feed materials which eliminates the production of a solid coke product and replaces the coke product with a higher value, pumpable tar liquid material which can be used as an asphalt paving material, as a fuel oil, or for other purposes. A hydrocarbon cooling and diluting material is added to and mixed with the tar material in the coking drum after the fill cycle to produce the liquid tar product and eliminate the steam-out, quenching, draining, unheading, hydraulic cutting, reheading, pressure testing, and warm-up procedures previously required in delayed coking systems, and to also eliminate the environmental issues and costs associated therewith.

20 Claims, 4 Drawing Sheets

DELAYED THERMAL CRACKING SYSTEM, APPARATUS, AND METHOD

FIELD OF THE INVENTION

The present invention relates to a process, system, and apparatus for thermal cracking heavy hydrocarbon materials without producing petroleum coke.

BACKGROUND OF THE INVENTION

Delayed coking systems are commonly used in petroleum refineries for converting vacuum tower bottoms and/or other heavy (i.e., high boiling point) residual petroleum materials to petroleum coke and other products. The greater part of each barrel of heavy residual material processed in the coker will typically be recovered as fuel gas, coker gasoline/naphtha, light cycle oil (also commonly referred to by various other names such as light coker gas oil), and heavy cycle oil (also commonly referred to by various other names such as heavy coker gas oil).

A typical delayed coking system comprises: a combination tower or other fractionator; a fired heater; and at least a pair of vertical coking drums. The heavy coker feed is typically delivered to the bottom of the fractionator where it is combined with a heavy residual bottom product, commonly referred to as "recycle," produced in the fractionator. The resulting mixture is drawn from the bottom of the fractionator and then pumped through the heater and into at least one coking drum. Typically, multiple coking drums are operated in alternating cycles such that, while one drum (referred to herein as the "live" drum) is operating in a "fill cycle," another drum is operating in a second cycle (i.e., a "decoking cycle"). The decoking cycle typically comprises: a steam-out to fractionator stage; a steam-out to blow down stage; a water cooling/quenching stage which further solidifies the coke product within the drum; a water draining stage; a drum unheading stage; a hydraulic de-coking stage for cutting the solid coke mass into chunks; a reheading and pressure testing stage; and a warmup stage in which the coking drum is preheated with steam prior to returning to the filling cycle.

In the fill cycle, the hot feed material from the coker heater typically flows into the bottom of the live coking drum. Some of the heavy feed material vaporizes in the heater such that the material entering the bottom of the coking drum is a vapor/liquid mixture. The vapor portion of the mixture undergoes mild cracking in the coker heater and experiences further cracking as it passes upwardly through the coking drum. The hot liquid material undergoes intensive thermal cracking and polymerization as it remains in the coking drum such that the liquid material is converted to cracked vapor and petroleum coke.

The resulting combined overhead vapor product produced in the coking drum is typically delivered to the lower portion of the fractionator. The cracked vapor product is typically separated by the fractionator into gas, naphtha, light cycle oil, and heavy cycle oil products which are withdrawn from the fractionator, and a heavy recycle/residual material which flows to the bottom of the fractionator. The light and heavy cycle oil products are typically taken from the fractionator as side draw products which are further processed (e.g., in a fluid catalytic cracker) to produce gasoline and other desirable end products. As mentioned above, the heavy recycle material combines with the heavy coker feed material in the bottom of the fractionator and is pumped with the heavy feed material through the coker heater.

By way of example, but not by way of limitation, typical coker operating conditions and products specifications include: a coker heater outlet temperature in the range of from about 900° F. to about 950° F.; live coke drum pressures in the range of from about 20 to about 40 psig; live drum overhead temperatures in the range of from about 800° F. to about 820° F.; a fractionator overhead pressure in the range of from about 10 to about 30 psig; a fractionator bottom temperature in the range of from about 750° F. to about 780° F.; a light cycle oil draw temperature in the range of from about 450° F. to about 550° F.; a light cycle oil initial boiling point in the range of from about 300° F. to about 325° F.; a light cycle oil endpoint in the range of from about 600° F. to about 650° F.; a heavy cycle oil draw temperature in the range of from about 600° F. to 690° F.; a heavy cycle oil initial boiling point in the range of from about 470° F. to about 500° F.; and a heavy cycle oil end point in the range of from about 960° F. to about 990° F.

Unfortunately, coking systems are often the principal bottleneck in many refineries when it comes to increasing refinery production rates and to improving product quality. The operation of a delayed coking system is a combination batch-continuous process. While one drum is live (i.e., is being filled with hot feed material), another drum is being steamed out, quenched, decoked, and warmed.

The time required heretofore for performing drum filling and decoking operations, particularly decoking operations, in delayed coking systems has severely limited the maximum achievable throughput for these systems. By way of example, in the current delayed coking processes, the coking drums will typically operate on 18-hour cycles. Thus, while one drum is operating in an 18-hour filling cycle, another drum will be operating in an 18-hour decoking cycle.

The cycle length required for most delayed coking systems will typically be determined by the total amount of time necessary to perform all of the various operations which occur during the decoking cycle. A typical 18-hour decoking cycle involves: about 0.5 hour for a steam-out to fractionator operation; about 1.0 hour for a steam-out to coker blowdown operation; about 5.5 hours for a water quench/fill operation; about 2.0 hours for a quench water draining operation; about 0.5 hour for a drum unheading operation; about 3.0 hours for a decoking (i.e., hydraulic cutting) operation; about 1.0 hour for reheading the coking drum and conducting a pressure test to verify that the drum has not been damaged; and about 4.5 hours for warming the drum with steam to return the drum to its operating temperature.

In addition to the low value of the coke product produced, and the fact that the delayed coking system is often a bottleneck for the entire refinery, delayed coking systems also present numerous other mechanical and environmental problems and challenges.

Many, if not most, of the problems, disadvantages, and shortcomings of delayed coking processes are associated with the hydraulic cutting operation which must be conducted during the decoking cycle in order to break up the solid coke product which has formed in the coking drum. For a coking drum operating on typical 18-hour coking and decoking cycles, a total of about four hours is required for unheading the top of the drum, conducting the hydraulic cutting operation, and then reheading the drum. In addition, when the coking drum is unheaded in order to conduct the hydraulic cutting operation, a significant amount of volatile organic carbon (VOC) material is released to atmosphere. Further, the tremendous stresses placed on the coking drums during the unheading and reheading operations create a significant potential for drum damage and down time.

Moreover, perhaps the most significant problems and disadvantages associated with the hydraulic cutting operation result from the tremendous amount of wastewater which is produced and which must be processed in the refinery's wastewater treatment system. In excess of 50%, and commonly as much as 75% or more, of the wastewater volume generated during a drum decoking cycle will be produced during the hydraulic cutting operation. In order to allow this water to be recycled for use in the hydraulic cutting system, it must first be processed in a coke fines removal system in order to adequately remove particulate materials from the water. Such systems take up a great deal of space and are very costly to install and operate. Also, in addition to the coke fines removal system, the hydraulic cutting system requires the use of high-pressure pumps, hydraulic drilling and cutting tools, tool hoists, feed water storage vessels, and other equipment and systems which are costly to install and maintain.

SUMMARY OF THE INVENTION

The present invention provides a thermal cracking process, system, and apparatus for coker feed materials which eliminates the production of a solid coke product and replaces the coke product with a higher value, pumpable tar liquid material which can be used as a paving material, as a fuel oil, or for other purposes. Moreover, the inventive process and system alleviate the other problems and shortcomings associated with delayed coking systems and can be used for converting existing delayed coking units or for constructing new delayed thermal cracking units.

In one aspect, there is provided a process for thermal cracking a hydrocarbon feed material in a coking drum. The process preferably comprises the steps of: (a) heating the hydrocarbon feed material to a cracking temperature to produce a heated feed material; (b) delivering the heated feed material into the coking drum during a filling cycle in which the heated feed material undergoes thermal cracking to produce a cracked vapor product, which is recovered from the coking drum, and a tar material which remains in the coking drum; and (c) switching the coking drum from the filling cycle to a cooling, diluting, and emptying cycle in which the delivery of the heated feed material into the coking drum is stopped and a hydrocarbon cooling and diluent material is delivered into the coking drum while rotating a mixer in the coking drum, which mixes the hydrocarbon cooling and diluent material with the tar material to cool and dilute the tar material and substantially prevent the tar material from solidifying to form coke. The hydrocarbon cooling and diluent material preferably has an end point which is lower than the end point of the hydrocarbon feed material, and a temperature which is lower than the temperature of the tar material. The mixing of the hydrocarbon cooling and diluent material with the tar material produces a pumpable tar product.

In another aspect, there is provided a process of thermal cracking a hydrocarbon feed material which preferably comprises the steps of: (a) heating the hydrocarbon feed material to a cracking temperature of at least 850° F. to produce a heated feed material, the hydrocarbon feed material having a cut point of at least 825° F.; (b) delivering the heated feed material into a vertical drum during a filling cycle in which the heated feed material undergoes thermal cracking to produce a cracked vapor product, which is recovered from the vertical drum, and a tar material which remains in the vertical drum, the vertical drum having a mixer therein; and (c) switching the vertical drum from the filling cycle to a cooling, diluting, and emptying cycle in which the delivery of the heated feed material into the vertical drum is stopped and a hydrocarbon cooling and diluent material at a temperature in the range of from 235° F. to 450° F. is delivered into the vertical drum while the mixer is rotated in the vertical drum, which mixes the hydrocarbon cooling and diluent material with the tar material to cool and dilute the tar material and substantially prevent the tar material from solidifying to form coke. The tar material is preferably cooled in step (c) to a cooled temperature in a range of from 600° F. to 700° F. The hydrocarbon cooling and diluent material preferably has an end point which is greater than the cooled temperature. The mixing of the hydrocarbon cooling and diluent material with the tar material produces a pumpable tar product.

The mixer provided in the vertical drum preferably comprises (i) a drive shaft which extends downwardly in the vertical drum, (ii) a bearing or bushing in which a lower end of the drive shaft is rotatably held, the bearing or bushing being mounted in a lower end portion of the vertical drum or outside of a lower end of the vertical drum, and (iii) a mixing stage positioned on the drive shaft at a location which is below a fill level to which the vertical drum is filled with the tar material in step (b), the mixing stage comprising a plurality of mixing paddles, blades, or other mixing elements which extend outwardly from the drive shaft.

As noted above, the inventive process, system, and apparatus replace the production of solid petroleum coke with a higher value, pumpable, liquid product which can be used as a paving material, a fuel oil material, or for other purposes. Moreover, the present invention entirely eliminates the steam-out, quenching, draining, unheading, hydraulic cutting, reheading, pressure testing, and warm-up procedures previously required in delayed coking systems. Consequently, as a result of these improvements, the inventive process and system will reduce the current 18-hour cycle time of an existing delayed coking unit to a cycle time in the range of only 6-10 hours, thus significantly increasing the capacity of the delayed coking unit and eliminating the coking unit as a refinery bottleneck.

In addition, by eliminating the steam-out, quenching, draining, unheading, hydraulic cutting, reheading, and warm-up procedures, the present invention also: (a) eliminates the wastewater production associated with these procedures; (b) eliminates the need to install, operate, and maintain hydraulic decoking systems for the coking drums; (c) eliminates the need to purchase, install, operate, and maintain a coke fines removals system for wastewater treatment; (d) eliminates the potential for damage to the coking drums which existed because of the need to perform repeated unheading and reheading operations; and (e) prevents the release of VOCs to the atmosphere which previously occurred as a result of the drum unheading procedure.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
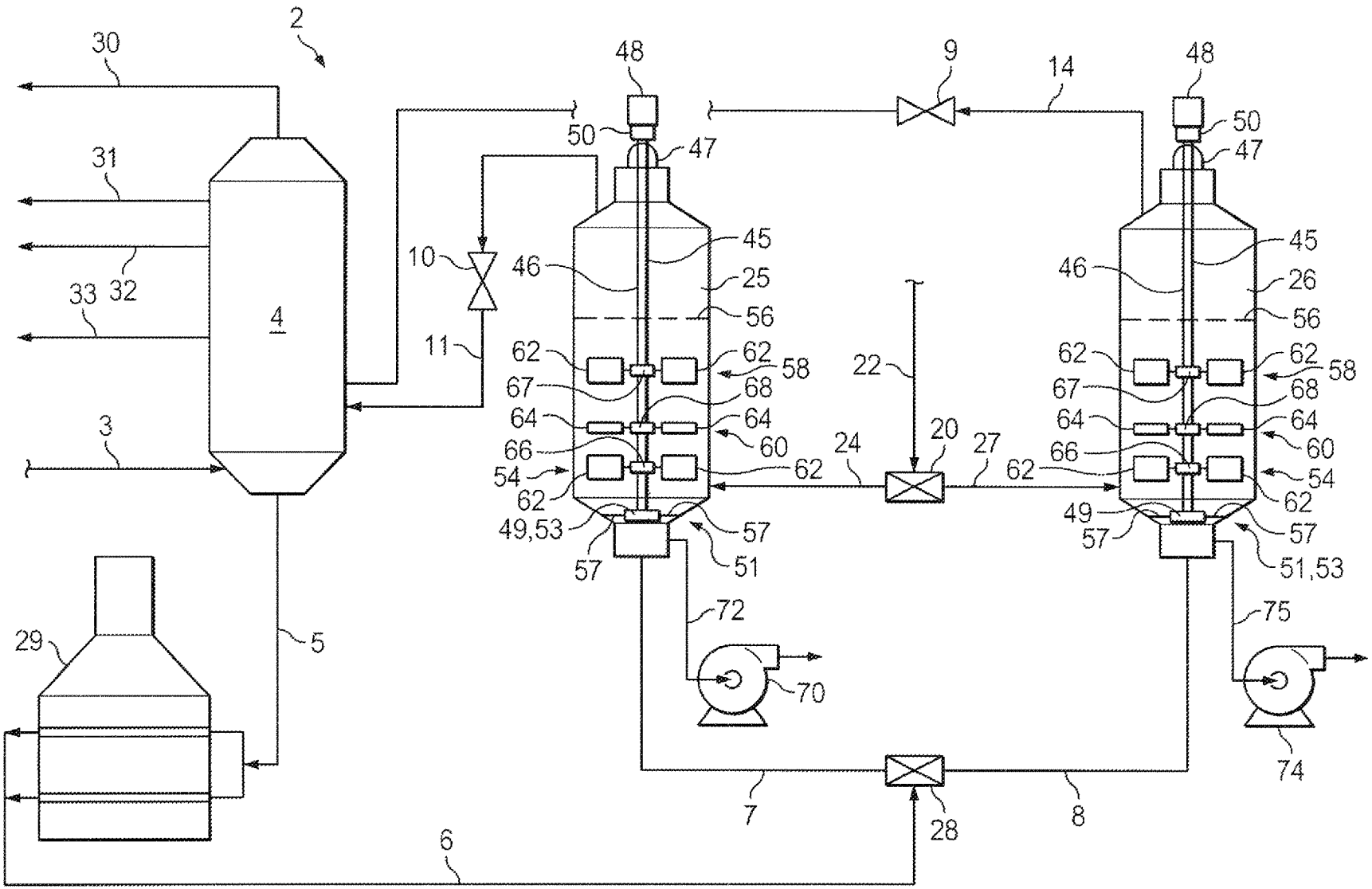
FIG. 1 schematically illustrates an embodiment 2 of the delayed thermal cracking system provided by the present invention.

In a preferred embodiment of the process of the present invention, a fresh feed material which preferably comprises one or more heavy (i.e., high boiling point) refinery material (s) of the type typically processed in a delayed coking unit, is heated to a cracking temperature. By way of example, but not by way of limitation, the cracking temperature will preferably be at least 875° F. (more preferably at least 900° F. or at least 920° F., and more preferably from 920° F. to 980° F.). The fresh feed material can be combined with a fractionator bottoms product (recycle) prior to heating the feed material to the cracking temperature. After heating to a cracking temperature, the heated feed material is delivered into a vertical coking drum or other vertical drum during a drum fill cycle in which the heated feed material undergoes thermal cracking to produce a cracked vapor product, which preferably flows to the unit fractionator, and a tar material which accumulates in the vertical drum.

Once the tar material in the vertical drum reaches a desired fill level, the flow of the heated feed material to the drum is stopped and the drum is switched to a cooling and diluting cycle in which a hydrocarbon cooling and diluent material is delivered into the vertical drum. During the cooling and diluting cycle, a mixer located within the vertical drum is rotated to mix the hydrocarbon cooling and diluent material with the tar material to thereby cool and dilute the tar material and substantially prevent the tar material from solidifying to form coke. By way of example, but not by way of limitation, once the diluted tar material has been cooled to a temperature which is preferably in the range of from 600° F. to 700° F. (more preferably from 625° F. to 675° F. and most preferably about 650° F.), the addition of the cooling and diluting material is stopped, and the diluted tar material is pumped out of the vertical drum as a pumpable tar product.

The mixer is preferably also rotated in the vertical drum during the till cycle while the heated feed material is added to the vertical drum. The mixer will preferably rotate at the same speed during the filling cycle and the cooling, diluting, and emptying cycle. The rotational speed of the mixer will preferably be in the range of from 5 to 100 revolutions per minute (RPM) and will more preferably be in the range of from 35 to 50 RPM. Alternatively, the mixer can be rotated at a higher speed during the cooling, diluting, and emptying cycle than during the fill cycle.

As used herein and in the claims, the terminology "substantially prevent the tar material from solidifying to form coke" means that none of the tar material or no more than 5% by weight of the tar material solidifies to form coke.

By cooling the tar material to a temperature which is not less than 600° F. and is more preferably not less than 625° F., the temperature of the vertical drum remains sufficiently warm that the drum can be switched directly back from the cooling, diluting, and emptying cycle to the till cycle without having to preheat the drum with steam prior to filling.

By way of example, but not by way of limitation, the fresh feed material used in the inventive process can comprise one or more of a crude unit vacuum tower bottoms product (i.e., "vacuum resid"), a crude unit atmospheric tower bottoms product ("atmospheric resid"), a heavy crude oil, and/or any other heavy (i.e., high boiling point) refinery material of the type typically processed in a delayed coking unit. By way of example, but not by way of limitation, the fresh feed material will preferably have cut point of at least 825° F. and will more preferably have a cut point of at least 850° F. or at least 875° F. or at least 900° F., or at least 920° F., or at least 935° F., or at least 950° F.

By way of example, but not by way of limitation, the tar material in the vertical drum at the end of the fill cycle will typically have a cut point of at least 850° F. (more typically at least 900° F. or at least 920° F. or at least 940° F. or at least 960° F.), a viscosity at 404° C. in the range of from 125,000 to 225,000 centipoise (cP) (more typically from 150,000 to 200,000 cP), a density of from 120 to 140 lb/ft3, and a specific gravity of from 1.9 to 2.3.

As used herein and in the claims, the terms "initial boiling point" and "end point" refer to the beginning and final temperature points of the boiling point curve of the particular hydrocarbon material in question as determined using ASTM DI 160 or other standard test methods of distillation for petroleum products. As also used herein and in the claims, the term "true boiling point cut point" or "TBP cut point" or "cut point" refers to the temperature which represents the lower (beginning) end of a distillate fraction or bottoms product on the true boiling point curve of a crude oil, or represents the TBP beginning point of a fraction or bottoms product which is not distilled directly from crude oil (e.g., a coker fractionator bottoms product).

The hydrocarbon cooling and diluent material can be generally any refinery stream or material which will be effective for cooling the tar material in the vertical drum and for diluting the tar material such that the viscosity of the tar material at the end of the cooling, diluting, and emptying cycle is reduced. To ensure that at least a portion of the hydrocarbon cooling and diluting material is not boiled off during the cooling and diluting cycle so that the remaining liquid cooling and diluting material remains in mixture with and dilutes the tar material, the end point of hydrocarbon cooling and diluting material will preferably be greater than the temperature to which the tar material is cooled at the end of the cooling, diluting, and emptying cycle.

The initial boiling point of the hydrocarbon cooling and diluent material will preferably be lower than the initial boiling point of the hydrocarbon feed material and the end point of the hydrocarbon cooling and diluent material will preferably be lower than the end point of the hydrocarbon feed material. By way of example, but not by way of limitation, the initial boiling point of the hydrocarbon cooling and diluent material will preferably in the range of from 440° F. to 640° F. and will more preferably be in the range of from 550° F. to 600° F. The end point of the hydrocarbon cooling and diluent material will preferably be at least 800° F. and will more preferably be at least 850° F. or at least 875° F. or at least 900° F. or at least 925° F. or at least 950° F. The end point of the hydrocarbon cooling and diluent material will preferably be in the range of from 900° F. to 975° F.

Examples of refinery streams and materials suitable for use in the inventive method as the hydrocarbon cooling and diluent material include, but are not limited to, a fluid catalytic cracker clarified oil product, a refinery slop oil material, a refinery fuel oil material, a heavy cycle gas oil, or a combination thereof. The hydrocarbon cooling and diluent material will preferably be a lower value refinery stream or material.

The temperature of the cooling and diluting material will preferably be less than the desired temperature of the tar material at the end of the cooling, diluting, and emptying cycle. The temperature of the hydrocarbon cooling and diluent material will more preferably be in the range of from 230° F. to 450° F., more preferably from 250° F. to 400° F., and will most preferably be in the range of from 250° F. to 350° F. Delivering the hydrocarbon cooling and diluent material at a temperature of at least 230° F. and more preferably at least 250° F. ensures that any water present in the hydrocarbon cooling and diluent material, such as when using refinery slop oil, will already be in vapor form or will immediately flash when the hydrocarbon cooling and diluent material enters the vertical drum.

The amount of the hydrocarbon cooling and diluting material added to the vertical drum will be the amount necessary to cool the tar material in the drum to its desired end temperature for removal. The amount of the hydrocarbon cooling and diluent material added to the drum will preferably be in the range of from 15% to 65% by weight, more preferably from 25% to 50% by weight, of the total weight of the tar material in the drum. Depending upon the initial boiling point of the hydrocarbon cooling and diluting material, a significant amount of the cooling and diluting material may be vaporized and flow to the unit fractionator during at least the initial portion of the cooling and diluting cycle, during which time the temperature of the tar material is the greatest. The proportion of the incoming cooling and diluting material which is vaporized during the cooling and diluting cycle will decline as the temperature of the tar material is reduced.

The pumpable liquid tar material produced by the inventive process can be used as an asphalt paving material, as a fuel oil, or for other purposes. The properties of the pumpable tar product material can be varied, for example, by changing the composition of the fresh feed material, changing the composition of the hydrocarbon cooling and diluting material, adjusting the operating parameters of the unit fractionator to change the composition of the fractionator bottoms (recycle) product, etc. The amount of the hydrocarbon cooling and diluent material added to the tar material will preferably be an amount effective to provide a pumpable liquid tar material having a viscosity at 650° F. (343° C.) of less than 500 cP, more preferably less than 450 cP or less than 400 cP or less than 350 cP or less than 300 cP or less than 250 cP or less than 200 cP, or less than 150 cP or less than 100 cP. Most preferably, the flowable liquid tar product material will have a viscosity at 650° F. in the range of from 20 to 100 cP.

FIG. 1 schematically illustrates an embodiment 2 of the delayed thermal cracking system provided by the present invention. The heavy fresh feed stream flows through conduit 3 to the bottom portion of a fractionator 4. In the bottom of fractionator 4, heavy fractionator bottoms liquid (recycle) combines with fresh feed material to form a heavy hydrocarbon feed stream which is pumped via conduit 5 through the fired-heater 29. The heated feed material then flows through conduit 6 to a switch valve 28.

The inventive thermal cracking system 2 depicted in FIG. 1 preferably includes at least two vertical drums 25 and 26, each having a mixer 46 rotatably installed therein. The vertical drums 25 and 26 can be existing drums, new vertical coking drums, or other vertical drum structures. The vertical drums 25 and 26 are operated in alternating cycles such that, when one drum (i.e., the live drum) is operating in the fill cycle, the other drum will be operating in the cooling, diluting, and emptying cycle.

If drum 25 is operating in the fill cycle, the switch valve 28 diverts the hot feed material to the bottom of drum 25 via conduit 7. However, if drum 26 is operating in the fill cycle, the switch valve 28 diverts the hot feed material to the bottom of drum 26 via conduit 8. Assuming, for illustration purposes, that drum 25 is operating in the till cycle, the overhead valve 10 for drum 25 will be open such that the cracked vapor produced in live drum 25 during the fill cycle will flow to the fractionator 4 via line 11. However, if drum 26 is operating in the fill cycle, the overhead valve 9 for drum 25 will be open such that the cracked vapor produced in live drum 26 during the fill cycle will flow to the fractionator 4 via line 14.

The hydrocarbon cooling and diluent material stream is delivered to a switch valve 20 of the inventive system 2 via conduit 22. If drum 25 is operating in the cooling/diluting/emptying cycle, the switch valve 20 will direct the cooling and diluent material stream to drum 25 via conduit 24. During the cooling, diluting, and emptying cycle, the overhead valve 10 will preferably remain open so that any of the hydrocarbon cooling and diluent material which is vaporized during the tar cooling process in drum 25 will flow via the overhead line 11 to the fractionator 4.

Similarly, if vertical drum 26 is operating in the cooling/diluting/emptying cycle, the switch valve 21) will direct the cooling and diluent material stream to drum 26 via conduit 27 and the overhead valve 9 of the drum 26 will remain open so that any of the hydrocarbon cooling and diluting material which is vaporized during the tar cooling process in drum 26 will flow via the overhead line 14 to the fractionator 4.

Although the hydrocarbon cooling and diluent material can be delivered to generally any location of the drum 25 or 26, the cooling and diluent material will preferably be delivered into the bottom portion of the drum. If drums 25 and 26 are existing coke drums, possible tie-ins for the cooling and diluent material conduits 24 and 27 could be provided by existing steam-out connections at the bottoms of drums 25 and 26 which, in accordance with the inventive thermal cracking process, will no longer be needed as part of a decoking stage.

Although two vertical drums 25 and 26 are shown in FIG. 1, it will be understood that the inventive delayed thermal cracking system 2 could alternatively utilize more than two vertical drums or only a single vertical drum. It will also be understood that it is not essential for the fresh feed material to be delivered to the fractionator 4 but could instead, for example, be delivered (a) directly to the heater 29, (b) to a pre-flash tower, or (c) to some other pre-cracking apparatus or system.

As with the fractionator used in a delayed coking system, the fractionator 4 of the inventive thermal cracking system 2 will preferably include typical pump around and condensing systems (not shown) for fractionating the cracked vapor product. In addition, the fractionated products produced by the fractionator 4 will typically also correspond to the products produced by a coker fractionator. The fractionator products will typically include: an overhead cracked gas (e.g., fuel gas) product 30; an overhead gasoline/naphtha distillate product 31; a light cycle oil side draw product 32; and a heavy cycle oil side draw product 33.

Many of the preferred operating conditions and parameters for the inventive process and system 2 have been presented above. As with a delayed coking unit, the operating conditions (i.e., temperatures, pressures, etc.) employed in the inventive thermal cracking system 2 can vary substantially depending upon: the specific fresh feed used; the desired product specifications; the desired product make; the unit design; etc. Generally, typical operation conditions such as those described above for delayed coking systems, or any other conditions and parameters desired, can be used in conducting the inventive thermal cracking process.

The mixer 46 installed in each of the vertical drums 25 and 25 preferably comprises a drive shaft 45 which extends downwardly in the drum 25 or 26 and has an upper end 47 which extends through the flange of the upper opening of the drum 25 or 26 and a lower end which is rotatably received and held in a bearing or bushing 49 which is mounted in the lower end portion of the drum 25 or 26, preferable about midway up the conical segment 51 at the bottom of the drum 25 or 26. Each mixer 46 preferably also comprises: (a) an exterior motor 48 and gear box 50 which are directly or indirectly connected to the upper end 47 of the drive shaft 45 and (b) at least one mixing stage 54 which is located on the drive shaft 45 below a fill line 56 to which the vertical drum 25 or 26 is filled with the tar material during the filling cycle. The motor 48 will preferably be a hydraulic or an electric motor.

The bearing or bushing 49 which rotatably receives and holds the lower end of the drive shaft 45 prevents the drive shaft 45 from vibrating. The housing 53 for the bearing or bushing also includes a gland, which is positioned on top of the bearing or bushing 49 for sealing the lower end of the drive shaft 45 against the fluid in the drum 25 or 26. The bearing or bushing 49 is preferably mounted in the center of the bottom portion of the drum 25 or 26 (most preferably in the bottom conical segment 51 of the drum as mentioned above) by a plurality of (most preferably four) radial support arms or spokes 57 which are welded or otherwise secured between the interior wall of the vertical drum 25 or 26 and the bearing housing 53. The bearing or bushing 49 is preferably a roller bearing.

Although other types of mixing stages can be used, the mixing stage 54 will preferably comprise one or more, more preferably a plurality, more preferably two, mixing paddles, blades, or other mixing elements 62 (preferably pitched paddles or blades) which extend radially outward from the drive shaft 45.

The mixer 46 preferably comprises at least a pair of mixing stages 54 and 58 and at least one agitating stage 60 which are mounted on the drive shaft 45. The mixing stage 54 is preferably in a bottom end portion of the vertical drum 25 or 26, most preferably just above the conical segment 51. The mixing stage 58, which is preferably identical to the mixing stage 54, is preferably located above the mixing stage 54 but also below the drum fill line 56. The agitator 60 is preferably located on the drive shaft 45 between the lower mixing stage 54 and the upper mixing stage 58. Although other types of agitating stages can be used, the agitating stage 60 preferably comprises one or more, more preferably a plurality, more preferably two, rods or bars 64, more preferably cylindrical rods, which extend radially outward from the drive shaft 6. The agitator bars or rods 64 will strike and break up small pieces of solidified coke which happen to form in the tar material.

The drive shafts 45, mixing stages 54 and 58, and agitating stages 60 of the mixers 46 remain in the vertical drums 25 and 26, i.e., are not removed from the drums 25 and 26, during repeated fill and cooling/diluting/emptying cycles. As noted above, the mixers 46 will preferably continuously rotate in the drums 25 and 26 at a constant speed throughout the repeated filling and cooling/diluting/emptying cycles. The rotational speed of the mixers 46 will preferably be in the range of from 5 to 100 RPM and will more preferably be in the range of from 35 to 50 RPM.

Alternatively, the mixers 46 can rotate at a faster speed during the cooling, diluting, and emptying cycle than during the filling cycle.

In order to withstand the extreme temperatures, temperature swings and other conditions experienced in the vertical drum 25 or 26, the elements of the rotatable mixer 46 will preferably be formed of heavy stainless steel or other material capable of withstanding and operating in such conditions.

Each of the mixing stage elements 62 and each of the agitating stage elements 64 preferably extends to a radial distance of from 1.5 to 4 feet, more preferably from 2 to 3 feet, from the drive shaft 45. In addition, the central hubs 66, 67, or 68 of the mixing and agitating stages 54, 58, and 60 are preferably spaced apart on the drive shaft 45 by a distance which is about 0.5 feet greater than the radial length of the mixing and agitating elements 62 and 64. This allows the drive shaft 45 and the mixing and agitating stages 54, 58, and 60 to be preassembled as illustrated in FIGS. 2-5 and lowered through the upper flange opening of the vertical drum 25 or 26, which is typically about 3 feet in diameter, by the use of foldable (preferably upwardly foldable) mixing and agitating elements 62 and 64.

Figure 3:
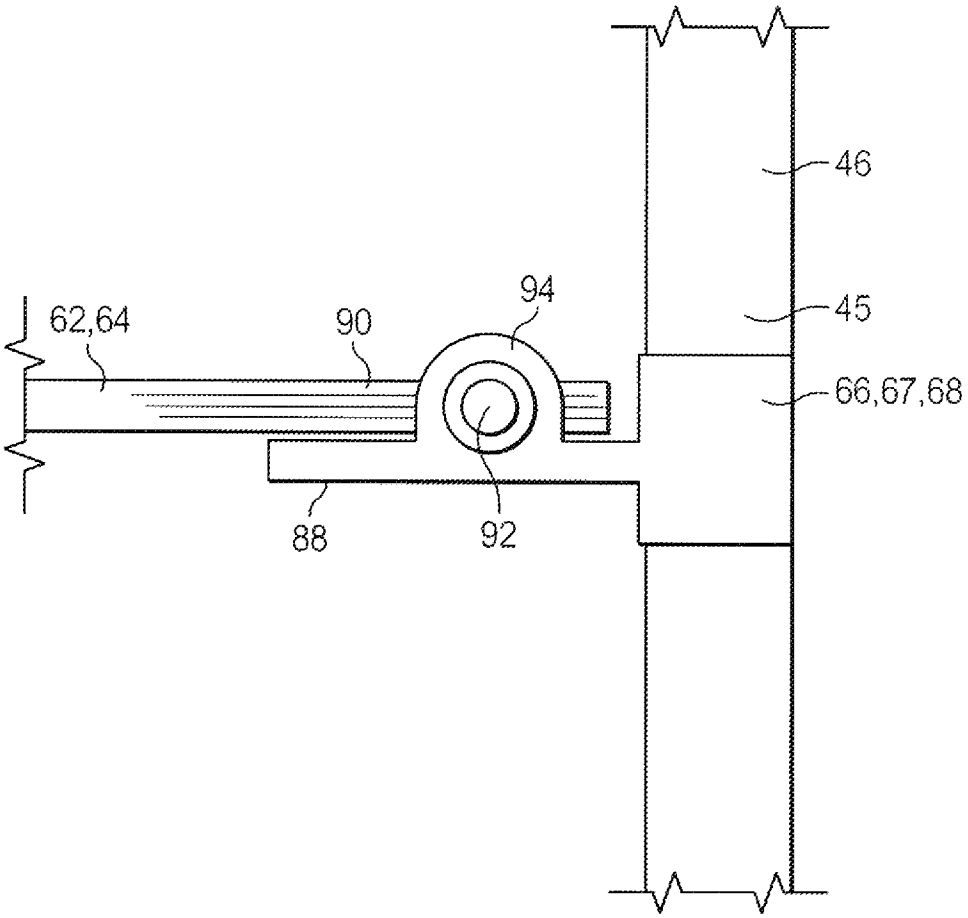
FIG. 3 schematically illustrates the pre-assembled mixing or agitating element 62 or 64 deployed in a horizontal operating position.
Figure 2:
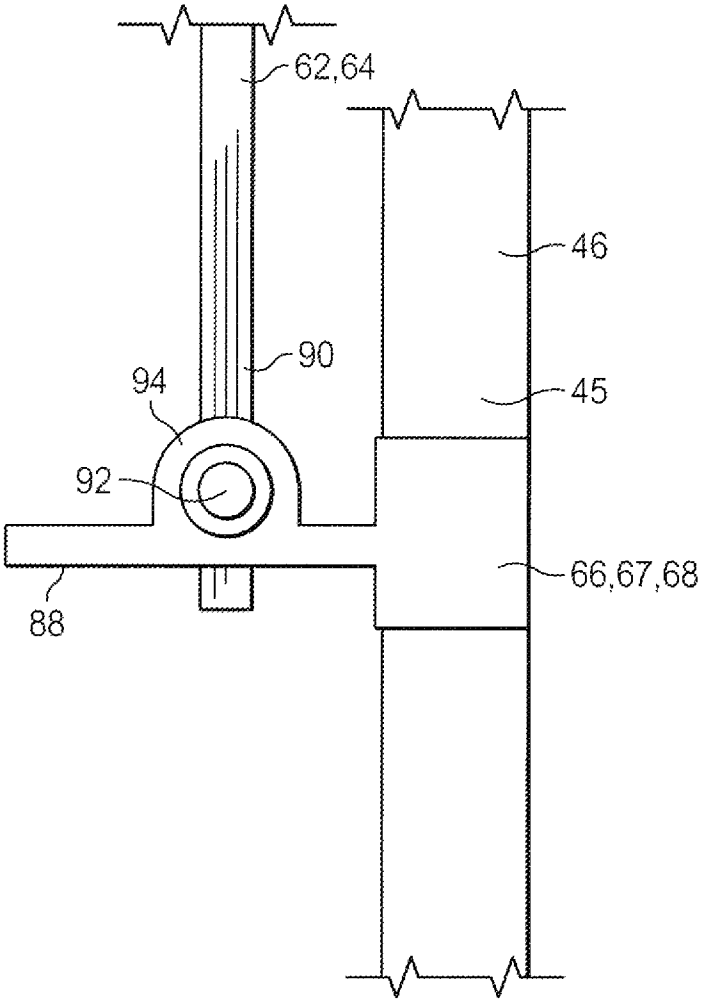
FIG. 2 schematically illustrates a pre-assembled mixing or agitating element 62 or 64 in a vertical position for installation in or removal from a vertical drum.
Figure 4:
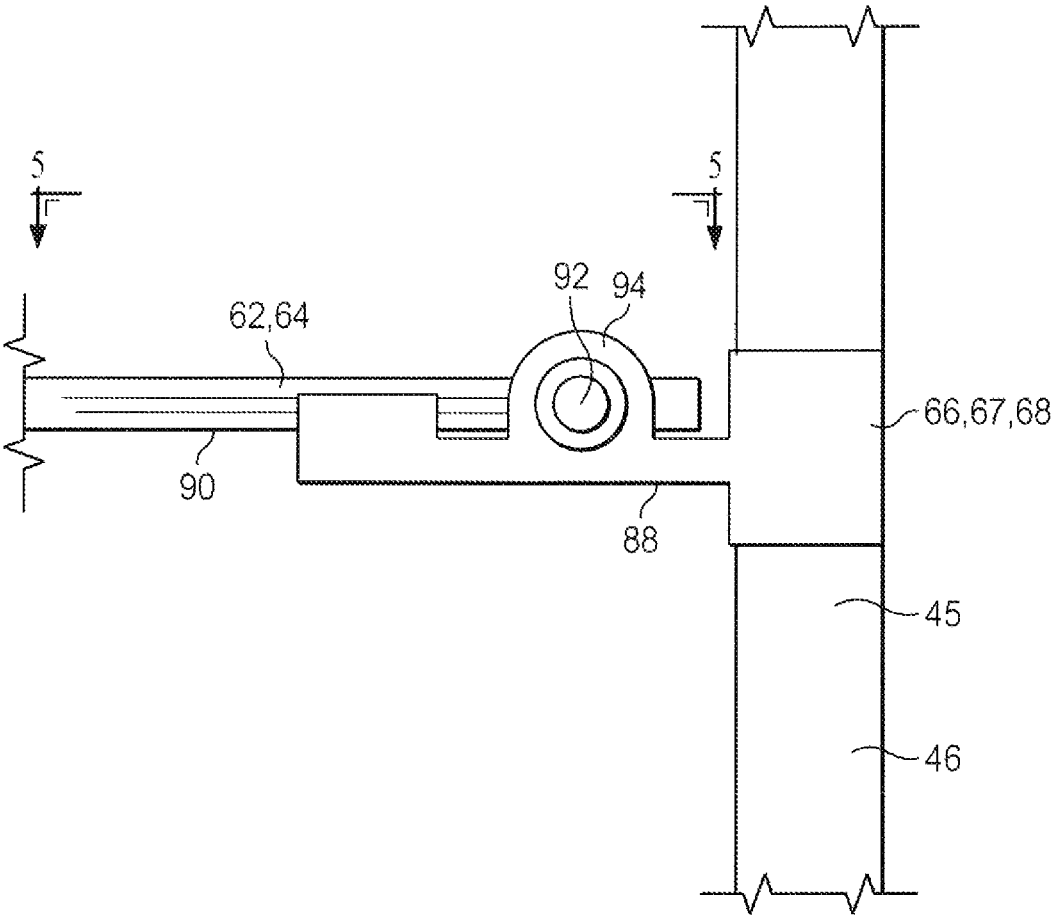
FIG. 4 schematically illustrates an alternative embodiment of the pre-assembled mixing or agitating element 62 or 64 in a horizontal operating position.
Figure 5:
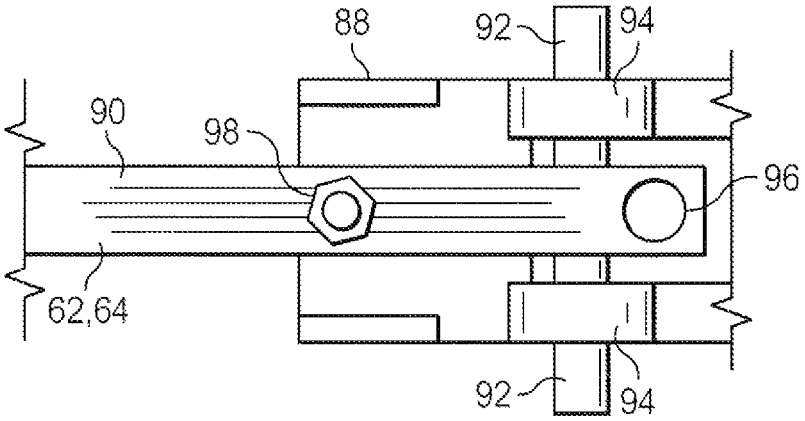
FIG. 5 is a top plan view of the deployed mixing or agitating element 62 or 64 as seen from perspective 5-5 shown in FIG. 4.

By way of example, the foldable version of each mixing or agitating element 62 or 64 may comprise: a short base structure 88 which is attached to and extends radially outward from the drive shaft 45; a base end portion 90 of the mixing or agitating element 62 or 64 which has laterally extending pivot arms 92 which are rotatably received in rotational brackets 94 extending upwardly from the base structure 88; a pull hole 96 provided through the base end portion of the mixing or agitating element 62 or 64 for running a cable or rope through the pull hole 96 for pivoting the element 62 or 64 downwardly from its vertical position as illustrated in FIG. 2 to a horizontal, radially extending, deployed position as illustrated in FIG. 3; and one or more sets of aligned apertures provided through the base end portion 90 of the mixing or agitating element 62 or 64 and through the base structure 88 for bolting the base end portion 90 of the mixing or agitating element 62 or 64 in deployed horizontal position on the base structure 88 using one or more bolts 98.

By way of further example, other alternative embodiments of the foldable impacting structures could utilize (a) latch clip assemblies which operate to automatically lock the mixing or agitating element 62 or 64 in horizontal deployed position when it is unfolded, and which can also preferably be unlocked from outside of the drum and (b) systems employing hydraulic or pneumatic pistons for folding and deploying the mixing and agitating elements.

In addition to these examples, it will be understood that other lengths for the mixing and agitating elements 62 and 64 and other techniques for installing the mixing and agitating elements 62 and 64 in the vertical drums 25 and 26 can be used. In addition to mixing the hydrocarbon cooling and diluting material with the tar material, the rotation of the mixer 46 in the vertical drum 25 or 26 during the cooling and diluting stage also operates to cool the tar material by causing turbulence in the drum 25 or 26 which promotes heat transfer through the wall of the drum 25 or 26.

In the inventive system 2, the flowable tar product material produced by the inventive process is pumped out of the bottom of the vertical drum 25 at the end of the cooling, diluting, and emptying cycle using a pump 70, in the case of an existing delayed coking drum, a tie-in for the flowable tar product line 72 may be provided by an existing quench water drainage connection in the bottom of the drum which will no longer be required for use in the inventive system as part of a quenching and decoking cycle.

Similarly, the flowable tar product material produced by the inventive process and system is pumped out of the bottom of the vertical drum 26 at the end of the cooling, diluting, and emptying cycle via conduit 75 using a pump 74. Alternatively, the same pump could be used to alternately pump the tar product material out of each of the drums 25 and 26 at the ends of their respective cooling, diluting, and emptying cycles.

Figure 6:
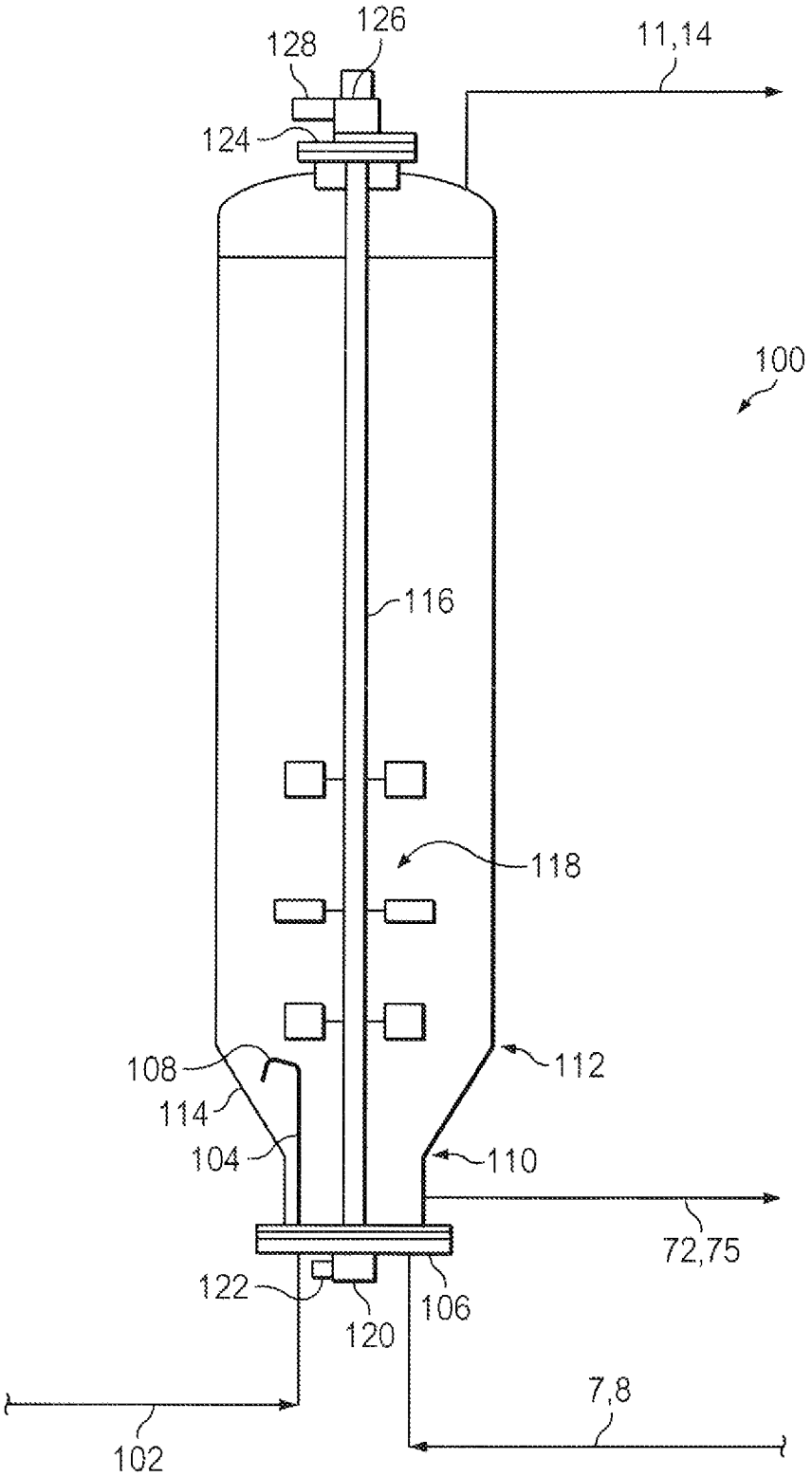
FIG. 6 schematically illustrates an alternative embodiment 100 of a vertical thermal cracking drum used in the inventive delayed thermal cracking system.

In an alternative embodiment of the present invention, each of the inventive vertical cracking drums 25 and 26 of the inventive thermal cracking system 2 can be replaced with an inventive vertical drum 100 as illustrated in FIG. 6. The inventive vertical drum 100 is preferably identical to vertical drums 25 and 26 except that: (i) the stream of hydrocarbon cooling and diluent material flows via a conduit 102 to the lower inlet end of an internal standpipe 104 in the vertical drum 100, (ii) the internal standpipe 104 extends upwardly from the bottom flange cover 106 of the drum 100 and has a curved upper end 108 which delivers the stream of cooling and diluent material downwardly into the drum 100 at a point which is preferably above the lower end 110 but below the upper end 112 of the bottom conical portion 114 of the drum 100; (iii) the lower end of the drive shaft 116 of the internal mixer 118 of the drum 100 extends through the bottom flange cover 106 and into an external flash oil or other cooling box 120 having a bearing (or bushing) and a gland therein for rotatably receiving the lower end of the drive shaft 116; (iv) the upper end of the drive shaft 116 extends through the top flange cover 124 of the drum 100; and (v) an external motor 126 is directly or indirectly connected to the upper end of the drift shaft 116 for rotating the internal mixer 118.

The following example is provided to illustrate but in no way limit the present invention.

Example

A heavy refinery residual material having a cut point of 1050° F. is delivered to the bottom of the fractionator 4 of the inventive delayed thermal cracking unit 2 illustrated to FIG. 1. In the inventive system 2, each of the drums 25 and 26 is replaced with a vertical drum 100 as illustrated in FIG. 6, but the two drums will continue to be referred to throughout the remainder of this example as drum 25 or drum 26.

The bottoms product in the fractionator 4 combines with the heavy feed material and the combined stream is then heated in the fired heater to a cracking temperature of 920° F. Next, the heated feed material is delivered into the bottom of the vertical drum 25 over the course of a 10-hour fill cycle. During the fill cycle, the mixer 118 in the drum 25 is rotated at 40 RPM.

The cracked vapor produced in the vertical drum 25 during the fill cycle flows to the fractionator 4 in which the cracked vapor is distilled to produce: an overhead fuel gas product 30; an overhead naphtha liquid product 31; a light cycle oil product 32; a heavy cycle oil product 33; and the bottoms product (recycle) which is combined with the heavy feed material.

The tar material which accumulates in the drum 25 during the till cycle is a very heavy tar having: a specific gravity at 15° C. of 2.09; an API Gravity of −63; a cut point of 1085'F'; and a viscosity at 402° C. of 150,000 centipoise (cP).

At the end of the 10-hour till cycle, the delivery of the heated feed material to drum 25 is stopped and drum 25 is switched from the till cycle to the cooling, diluting, and emptying cycle. The temperature of the heavy tar material in drum 25 at the end of the fill cycle is 905° F.

At the beginning of the cooling, diluting, and emptying cycle, as the internal mixer 118 continues to rotate at 40 RPM, a cooling and diluent material comprising a refinery stop oil stream at 300° F. is delivered into the bottom of the drum 25. The slop oil stream has: an ASTM D1160 initial boiling point of 440° F. and an end point of 975° F.; a specific gravity at 15° C. of 0.888; and an API gravity of 27.9.

During the cooling, diluting, and emptying cycle, an amount of the slop oil equaling 33% by weight of the weight of the tar material is delivered into the vertical drum 25 to reduce the tar material to a temperature of 650° F. and to produce a diluted pumpable tar liquid product having a viscosity at 650° F. of 35 cP. A portion of the slop oil stream which is vaporized in the vertical drum 25 during the cooling and diluting cycle is delivered to the fractionator 4.

The diluted tar product is pumped from the vertical drum 25 and drum 25 is then returned to the fill cycle. The pumpable tar product is used as a fuel oil or a road paving material.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. A process for thermal cracking a hydrocarbon feed material in a coking drum comprising the steps of:

a) heating the hydrocarbon feed material to a cracking temperature to produce a heated feed material;

b) delivering the heated feed material into the coking drum during a filling cycle in which the heated feed material undergoes thermal cracking to produce a cracked vapor product, which is recovered from the coking drum, and a tar material which remains in the coking drum; and c) switching the coking drum from the filling cycle to a cooling, diluting, and emptying cycle in which the delivery of the heated feed material into the coking drum is stopped and a hydrocarbon cooling and diluent material is delivered into the coking drum while rotating a mixer in the coking drum, which mixes the hydrocarbon cooling and diluent material with the tar material to cool and dilute the tar material and substantially prevent the tar material from solidifying to form coke, the hydrocarbon cooling and diluent material having an end point which is lower than an end point of the hydrocarbon feed material, and a temperature which is lower than a temperature of the tar material, and the mixing of the hydrocarbon cooling and diluent material with the tar material producing a pumpable tar product.

2. The process of claim 1 further comprising a portion of the hydrocarbon cooling and diluent material being vaporized in step (c) to produce a vapor product which is recovered from the coking drum.

3. The process of claim 1 further comprising:

the hydrocarbon feed material having a TBP cut point of at least 825° F. and the end point of the hydrocarbon cooling and diluent material being at least 800° F.

4. The process of claim 3 further comprising the hydrocarbon cooling and diluent material being a fluid catalytic cracker clarified oil product, a refinery slop oil material, a refinery fuel oil material, or a combination thereof.

5. The process of claim 1 further comprising:

the hydrocarbon feed material being heated to a temperature of at least 850° F. in step (a) and the temperature of the hydrocarbon cooling and diluent material being in a range of from 235° F. to about 450° F.

6. The process of claim 5 further comprising:

the tar material being cooled in step (c) to a cooled temperature in a range of from 600° F. to 700° F. and the end point of the hydrocarbon cooling and diluent material being greater than the cooled temperature of the tar material.

7. The process of claim 6 further comprising the steps of pumping the pumpable tar product out of the coking drum and then, without preheating the coking drum, returning the coking drum to the filling cycle in which the heated feed material produced in step (a) is delivered into the coking drum.

8. The process of claim 1 further comprising the hydrocarbon cooling and diluent material being delivered into a bottom portion of the coking drum in step (c).

9. The process of claim 1 further comprising the mixer also being rotated in the coking drum during step (b).

10. The process of claim 9 further comprising the mixer being rotated in the coking drum at a speed which is the same in step (c) as in step (b).

11. The process of claim 1 further comprising the mixer comprising:

a drive shaft which extends downwardly in the coking drum;

a bearing or bushing in which a lower end of the drive shaft is rotatably held, the bearing or bushing being mounted in a lower end portion of the coking drum or outside of a lower end of the coking drum; and a mixing stage positioned on the drive shaft at a location which is below a fill level of the coking drum to which the coking drum is filled with the tar material in step (b), the mixing stage comprising a plurality of mixing paddles, blades, or other mixing elements which extend radially from the drive shaft when rotating the mixer for mixing.

12. The process of claim 11 further comprising the mixing stage being positioned in a bottom end portion of the coking drum.

13. The process of claim 12 further comprising:

the mixing stage being a lower mixing stage;

the mixer further comprising a second mixing stage positioned on the drive shaft above the lower mixing stage, the second mixing stage being identical to the lower mixing stage; and the mixer further comprising an agitating stage positioned on the drive shaft above the lower mixing stage and below the second mixing stage.

14. A process of thermal cracking a hydrocarbon feed material comprising the steps of:

a) heating the hydrocarbon feed material to a cracking temperature of at least 850° F. to produce a heated feed material, the hydrocarbon feed material having TBP cut point of at least 825° F.;

b) delivering the heated feed material into a vertical drum during a filling cycle in which the heated feed material undergoes thermal cracking to produce a cracked vapor product, which is recovered from the vertical drum, and a tar material which remains in the vertical drum, the vertical drum having a mixer therein which comprises (i) a drive shaft which extends downwardly in the vertical drum and (iii) a mixing stage positioned on the drive shaft at a location which is below a fill level to which the vertical drum is filled with the tar material in step (b), the mixing stage comprising one or more mixing paddles, blades, or other mixing elements which extend outwardly from the drive shaft; and c) switching the vertical drum from the filling cycle to a cooling, diluting, and emptying cycle in which the delivery of the heated feed material into the vertical drum is stopped and a hydrocarbon cooling and diluent material at a temperature in a range of from 235° F. to 450° F. is delivered into the vertical drum while the mixer is rotated in the vertical drum, which mixes the hydrocarbon cooling and diluent material with the tar material to cool and dilute the tar material and substantially prevent the tar material from solidifying to form coke, the tar material being cooled in step (c) to a cooled temperature, the hydrocarbon cooling and diluent material having an end point which is greater than the cooled temperature, and the mixing of the hydrocarbon cooling and diluent material with the tar material producing a pumpable tar product.

15. The process of claim 14 further comprising the mixer also being rotated in the vertical drum during step (b).

16. The process of claim 15 further comprising the mixer being rotated at a speed which is the same in step (c) as in step (b).

17. The process of claim 14 further comprising the hydrocarbon cooling and diluent material being a fluid catalytic cracker clarified oil product, a refinery slop oil material, a refinery fuel oil material, or a combination thereof.

18. The process of claim 14 further comprising the hydrocarbon cooling and diluent material being delivered into a bottom end portion of the vertical drum in step (c).

19. The process of claim 14 further comprising:

the mixing stage being a lower mixing stage;

the mixer further comprising a second mixing stage positioned on the drive shaft above the lower mixing stage and below the fill level, the second mixing stage being identical to the lower mixing stage; and the mixer further comprising an agitating stage positioned on the drive shaft above the lower mixing stage and below the second mixing stage.

20. The process of claim 14 further comprising the steps of pumping the pumpable tar product out of the vertical drum and then, without preheating the vertical drum, returning the vertical drum to the filling cycle in which the heated feed material produced in step (a) is delivered into the vertical drum.

* * * * *